US005516996A

United States Patent [19]

Shin

[11] Patent Number: 5,516,996

[45] Date of Patent: May 14, 1996

[54] KEYBOARD APPARATUS

[75] Inventor: Young-Hyun Shin, Seoul, Rep. of Korea

[73] Assignee: BTC Corporation, Incheon-si, Rep. of Korea

[21] Appl. No.: 266,005

[22] Filed: Jun. 27, 1994

[30] Foreign Application Priority Data

Jul. 2, 1993 [KR] Rep. of Korea ..... 93-12376

[51] Int. Cl.[6] ..... H01H 13/70

[52] U.S. Cl. ..... 200/345; 200/512; 400/490

[58] Field of Search ..... 200/345, 344, 200/341, 512, 520, 517, 5 A; 400/480, 495, 485.1

[56] References Cited

U.S. PATENT DOCUMENTS

| | | | |
|---|---|---|---|
| 4,677,600 | 6/1987 | Yoshida | 367/127 |
| 5,172,990 | 12/1992 | Weng | 200/345 |
| 5,173,578 | 12/1992 | Tama | 200/345 |
| 5,324,902 | 6/1994 | Shen | 200/520 |
| 5,386,091 | 1/1995 | Clancy | 200/344 |

FOREIGN PATENT DOCUMENTS

| | | | |
|---|---|---|---|
| 267541 | 5/1988 | European Pat. Off. | 200/344 |
| 2278621 | 11/1980 | Japan | 200/512 |

*Primary Examiner*—David J. Walczak
*Attorney, Agent, or Firm*—Darby & Darby

[57] ABSTRACT

A keyboard apparatus according to this invention has a key button being formed with a key stem in a body to directly assemble with a key holder and separate from it. The key apparatus has a movable contact and a fixed contact of membrane structure, and has a key switch above the contact portion. The key switch comprises a rubber spring being formed above the contact position, a key holder to receive and guide a key button from upper side, and key button.

7 Claims, 7 Drawing Sheets

KEYBOARD APPARATUS

FIELD OF INVENTION

This invention relates to a keyboard apparatus used for electronic equipment such as electronic typewriters, personal computers, terminals, calculators, word processors and cash registers and the like, and more particularly to a keyboard apparatus having a plurality of simplified key switches structure in order to decrease the number of switch component parts thus reducing the production cost.

BACKGROUND OF THE INVENTION

A keyboard apparatus is a signal input apparatus inputting a relevant signal to a host side directly by way of depressing a certain key button out of the plurality of key buttons disposed in a predetermined positional relationship on a board in the electronic equipment. Although there have been various keyboard apparatuses proposed with different key switch structure with respect to each other, all of those keyboards perform the same function.

Namely, the key switches each are provided with a key button mounted thereon, wherein it is adapted such that depression of a certain key button out of the plurality of key buttons disposed on the board causes a movable contact in the key switch to come in contact with a fixed contact in a lower position of the key switch, and the contact between the movable contact and the fixed contact allows the keyed information signal to be output to the host side to operate the electronic equipment.

For example of this key board apparatus, U.S. Pat. No. 4,677,600 discloses the key switch structure being used of plate spring serving as an elastic member for contacting the movable contact to the fixed contact in the switch and separating the movable contact from the fixed contact. In addition to the plate spring, an elastic member such as a coil spring, a rubber spring and the like was proposed and has been used as an element of the general key switch structure.

The conventional keyboard apparatus generally has a problem that the structure of the key switch is very complicated. Particularly, since a key stem portion depresses the elastic member directly to move the movable contact into contact with the fixed contact in the key switch and a key top portion for allowing depression by a finger of a operator are mechanically separated from each other in the conventional type of apparatus. Thus, the number of the switch component parts is increased accordingly and thereby the production cost is expensive.

Also, since it is generally impossible to insert directly a key button into a key holder from the upper side after the key holder has been assembled into a frame of a keyboard apparatus in such a conventional type, the key stem portion of the key button should be inserted into the key holder before assembling the key holder. Therefore, the number of assembling steps is increased and it is not easy to automate the assembling process.

Moreover, since every key holders disposed on the conventional keyboard apparatus in predetermined positional relationship are separated from each other, it requires an additional key holder support to maintain the key holders on the keyboard and therefore the number of switch component part is increased.

SUMMARY OF THE INVENTION

It is an object of this invention to solve the problems described above by providing a keyboard apparatus having a structure designed to reduce the number of component parts by forming a key stem portion and key top portion in a body and to minimize manufacturing costs.

A further object of this invention is to provide a keyboard apparatus having a structure designed to directly insert a key button which is made by forming the key stem and key top in a body into a key holder from the upper side after assembling the key holder in a frame of the keyboard apparatus, and to thereby automate the assembling process.

Another object of this invention is to provide a keyboard apparatus having a structure in which a plurality of key holders disposed in predetermined position on a keyboard are united with respect to each other in a body without extra support.

To accomplish these objects of the invention, a keyboard apparatus is provided which comprises a main frame; a plurality of fixed contacts arranged on the main frame in a predetermined positional relationship; a plurality of movable contacts disposed above each of the fixed contacts with a predetermined gap; a rubber spring disposed on the movable contact and having a cup shape portion of resilient rubber opened toward the movable contact; a key button supported elastically on the rubber spring for up-and-down travel movement between a rest position and a depressed position, and having a key top portion for allowing depression by a finger of an operator and a key stem portion extending downwardly from a lower surface of the key top portion, a lower end of the key stem portion pressing the movable contact in the depressed position to bring into contact with the fixed contact; a key holder mounted on the main frame and having a key stem guide portion for receiving the key stem portion to guide the up-and-down travel movement of the key button and a rubber spring receiving portion for receiving at least the cup shape portion of the rubber spring, and the key stem portion of the key button being directly inserted into the key stem guide portion from upper side to assemble the key button with the key holder; and hooking means for preventing the key button from escaping upwardly from the key holder in the rest position.

In the preferred embodiment of this invention, the hooking means includes a hook having a leg extending downwardly from a lower surface of the key top portion in parallel with the key stem portion and a projection protruding transversely to the extending direction of the leg, and a stopping sill for cooperating with the hook.

In order to decrease the steps of assembling process it is also desirable that a plurality of the rubber springs and a plurality of the key holders respectively corresponding to the key buttons are formed in a body respectively by interconnecting each other.

It is also desirable, for transmitting a depression power from the key button to the lower rubber spring uniformly, that the lower end of the key stem portion of the key button has a cylindrical shape, and the rubber spring contacting the key stem portion includes an upwardly extending ring shape portion facing to the cylindrical key stem portion.

Other objects, features and advantages of the invention will become more apparent from the following description, including the appended claims and accompanying drawings.

BRIEF DESCRIPTION OF THE DRAWINGS

FIG. 1(*b*) is a perspective view from another direction showing the disassembled key switch shown in FIG. 1(*a*).

FIG. 2(*b*) is a side elevation view in cross section of the same key switch shown in FIG. 2(*a*), showing the condition in which the switch is depressed.

DETAILED DESCRIPTION OF THE INVENTION

Figure 1A:
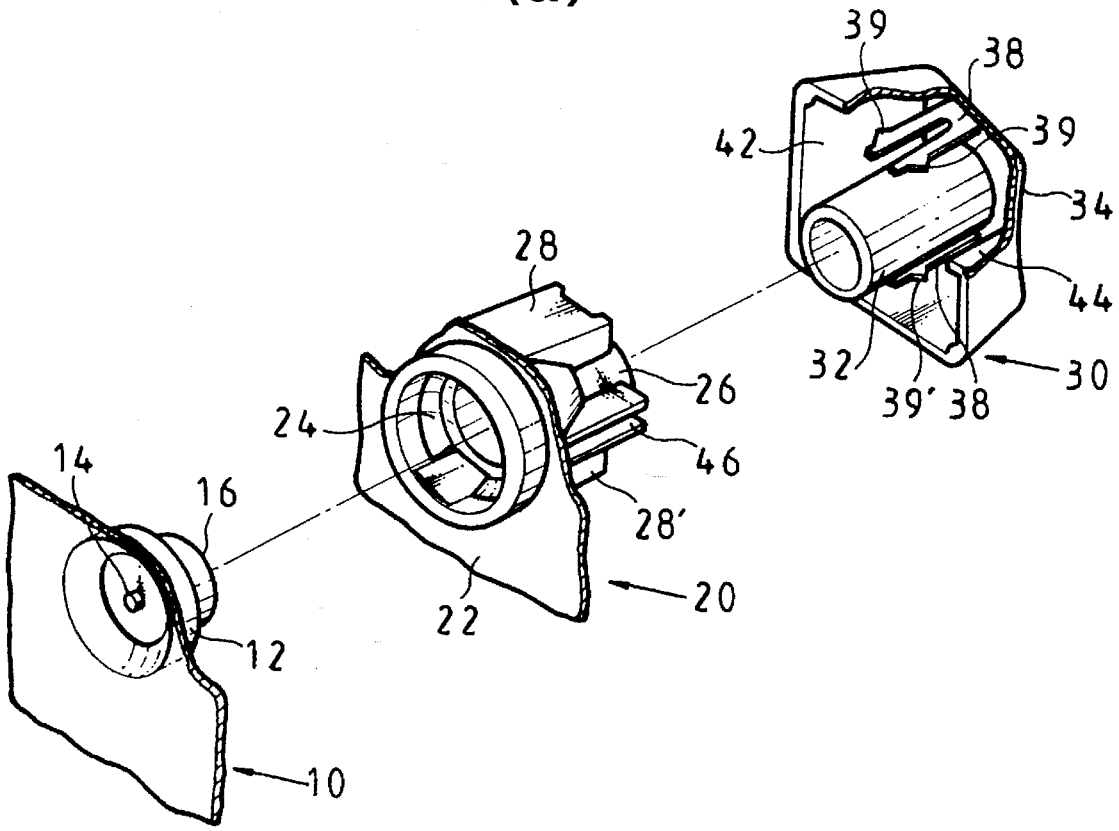
FIG. 1(*a*) is a perspective view showing a disassembled key switch according to an embodiment of this invention.
Figure 1B:
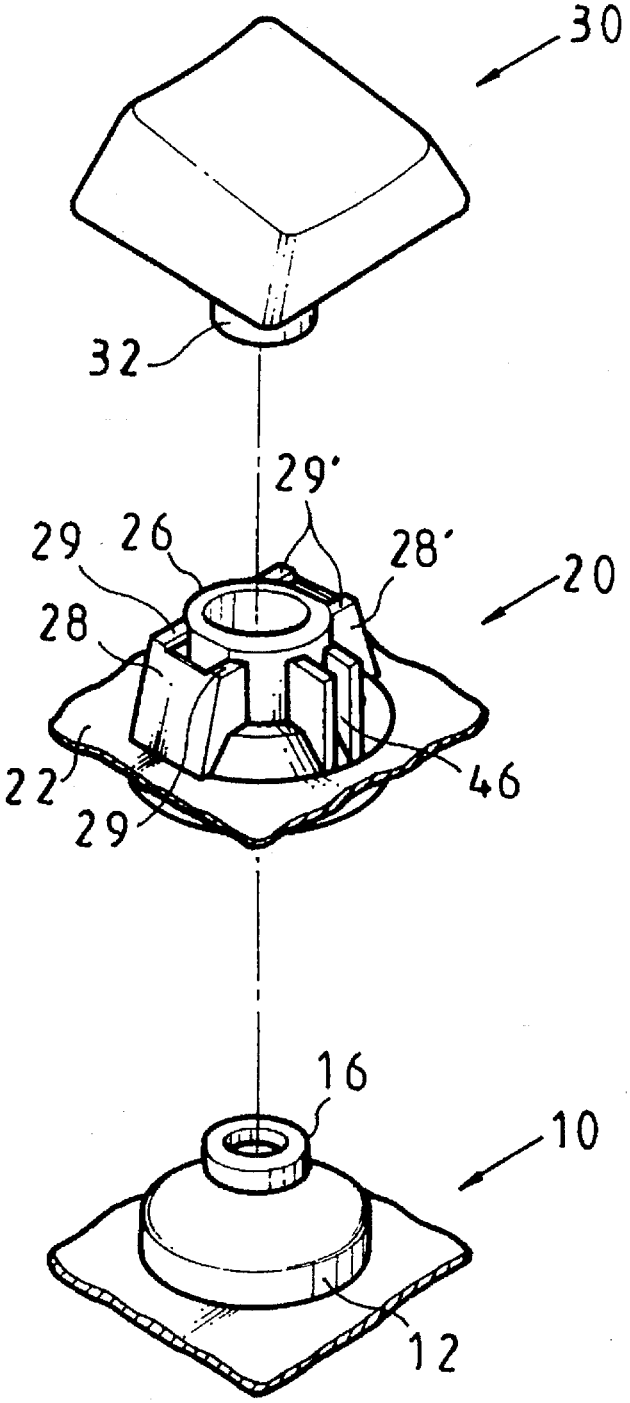

FIG. 1(*a*) shows a perspective view of a disassembled key switch according to an embodiment of this invention, and FIG. 1(*b*) shows another perspective view shown from another direction of the key switch shown in FIG. 1(*a*).

Referring to FIG. 1(*a*) and FIG. 1(*b*), a key switch according to this invention is composed of a rubber spring 10, a key holder 20, and a key button 30.

The rubber spring 10 is an elastic member of which the shape can be deformed by an exterior depression force, for example from depression of the key button, and the shape of the rubber spring 10 is restored from the deformation state (depressed position) to the original state (rest position) by its own resilient property when the depression force or power is removed. The spring 10 has a circular cup shape portion 12, a ring shape extending portion 16 extended upwardly on the upper surface of the cup shape portion 12, and a protruding portion 14 for forming a contact protruding from the lower surface of the cup shape portion 12 into the inner space of the cup shape portion 12. When a key button 30 is depressed from the upper side, the ring shape extending portion 16 delivers the power to the rubber spring 10 uniformly so that the shape of the rubber spring 10 can be transformed desirably. The protruding portion 14 for forming contact causes the power delivered from the key button 30 to be focused on a point so that the contact between a movable contact and a fixed contact disposed in the lower position of the rubber spring 10 in a keyboard apparatus can be accomplished accurately.

The key holder 20 inlcudes of a rubber spring receiving portion 24, a key stem guide 26, hook guide 28, 28', and a position defining pin guide 46. The key holder 20 is supported with a key holder supporting plate 22.

The rubber spring receiving portion 24 has an appropriate inner space in which the cup shape portion 12 of the rubber spring 10 can be received. Portion 24 extends downwardly from the key holder supporting plate 22 in a cylindric shape. The key stem guide 26 is formed to pass upwardly through the upper portion of the rubber spring receiving portion 24, and receives the key stem portion 32 of the key button 30 to thereby guide the up-and-down travel movement of the key button 30.

Hook guides 28, 28', are formed on the outer side of the key stem guide 26 in parallel with its longitudinal direction. The hook guides 28, 28' cooperate with the hook 38 inserted in the hook guides 28, 28' to thereby guide the hook 38 corresponding to the up-and-down travel movement of the key button 30. Each of the hook guides 28, 28' is formed on the opposite part of the key stem guide 6 to maintain the balance on the key holder. The respective lower portion of the hook guides 28, 28' are opened to pass downwardly through the rubber spring receiving portion 24. Stopping sills 29, 29' are formed on both side of the upper portion of the hook guides 28, 28' respectively in the shape of a projection protruded into the inner space of the hook guides 28, 28' in order to prevent the key button 30 assembled with the key holder 20 from escaping upwardly.

The key button 30 includes a key top portion 34, a key stem portion 32, a position defining pin 44, and hooks 38, 38'. The key top portion 34 contacts with a finger of a keyboard operator and has a rectangular shape having a concave region in the center corresponding to the finger shape. The surface of the key top portion 34 may be slanted to a horizontal level with an appropriate angle for the convenience of operating. Extending downwardly from the edges of the key top portion 34 is a rectangular supporting wall 42 that has a mushroom shape.

The key stem portion 32 extends downwardly from the lower surface of the key top portion 34 to contact the rubber spring 10 inserted into the key stem guide 26 of the key holder 20. The key stem portion 32 is formed in a cylindrical shape to deliver the power uniformly in association with the ring shape extending portion 16 of the rubber spring 10.

Each hook 38 or 38' has an approximately U-shape leg extending downwardly from the lower surface of the key top portion 34 in parallel with the key stem portion 32 and is opened toward the lower direction. A projection 39 or 39' protrudes transversely to the extending direction of the leg at its end region. The end portion of each of the legs of the hook 38 or 38' can move with respect to each other elastically in the transverse direction. Hooks 38, 38' can be depressed and inserted into the hook guides 28, 28' from the upper side to connect the button 30 to the key holder 20. The protruding projections 39, 39' at the end portion of the hooks 38, 38' cooperate with the stopping sills 29, 29' of the hook guides 28, 28' to prevent the key button 30 from escaping upwardly, and are formed in an approximately triangular shape. Therefore, the key button 30 can be assembled with the key holder 20 easily from the upper side, and also can be separated from the key holder 20 easily for changing or repairing the key button 30 with less work.

The position defining pin 44 is formed on one surface of the inner surfaces of the rectangular supporting wall 42 extended downwardly from the key top portion 34 in order to be located in the position defining pin guide 46 formed on the key holder 20. The position defining pin 44 determines an assembling direction of the key button 30.

Figure 2A:
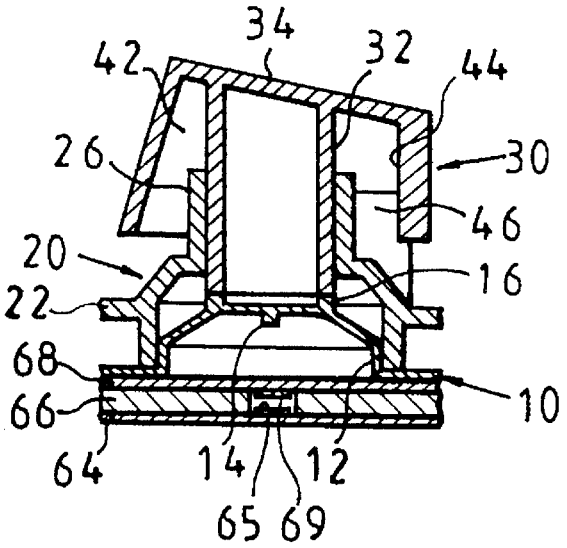
FIG. 2(*a*) is a side elevation view in cross section of a key switch according to this invention, showing the condition in which the switch is not depressed.
Figure 2B:
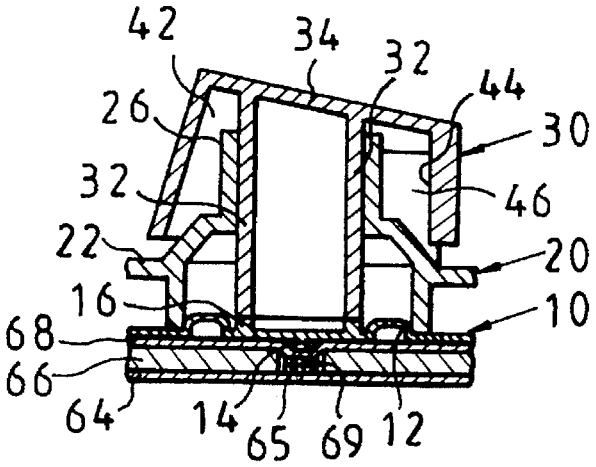

Referring to FIG. 2(*a*) and FIG. 2(*b*), operation of the key switch according to this invention will be described. The contact structure used in the embodiment of this invention is a membrane structure which is formed by stacking a lower sheet and an upper sheet, on which conduction layers are formed respectively.

FIG. 2(*a*) shows the key button 30 when it is not depressed. As shown in FIG. 2(*a*), a fixed contact 65 formed on the lower sheet 64 which is formed on a circuit substrate (not shown) of a keyboard apparatus and a movable contact 69 formed on the upper sheet 68 are separated from each other by a predetermined gap by inserting a spacer 66 therebetween. Therefore, in a rest position as shown in FIG.

2(*a*), the rubber spring 10 is maintained in an original position at which the key button 30 is not depressed, and an electrical conduction will not occur between the movable contact and the fixed contact.

FIG. 2(*b*) shows the key button 30 when it is depressed. As shown in FIG. 2(*b*), the rubber spring 10 is deformed by depressing the key button 30, and the protruding portion 14 formed on the lower surface of the cup shape portion 12 in the rubber spring 10 depresses the movable contact 69 to contact with the fixed contact 65, so that the keyed signal is transmitted to outer circuit (not shown) by electrical conduction between the movable contact and the fixed contact. Then, if the power supplied to the key button 30 is removed, the rubber spring 10 will be restored elastically to the rest position as shown in FIG. 2(*a*).

Figure 3:
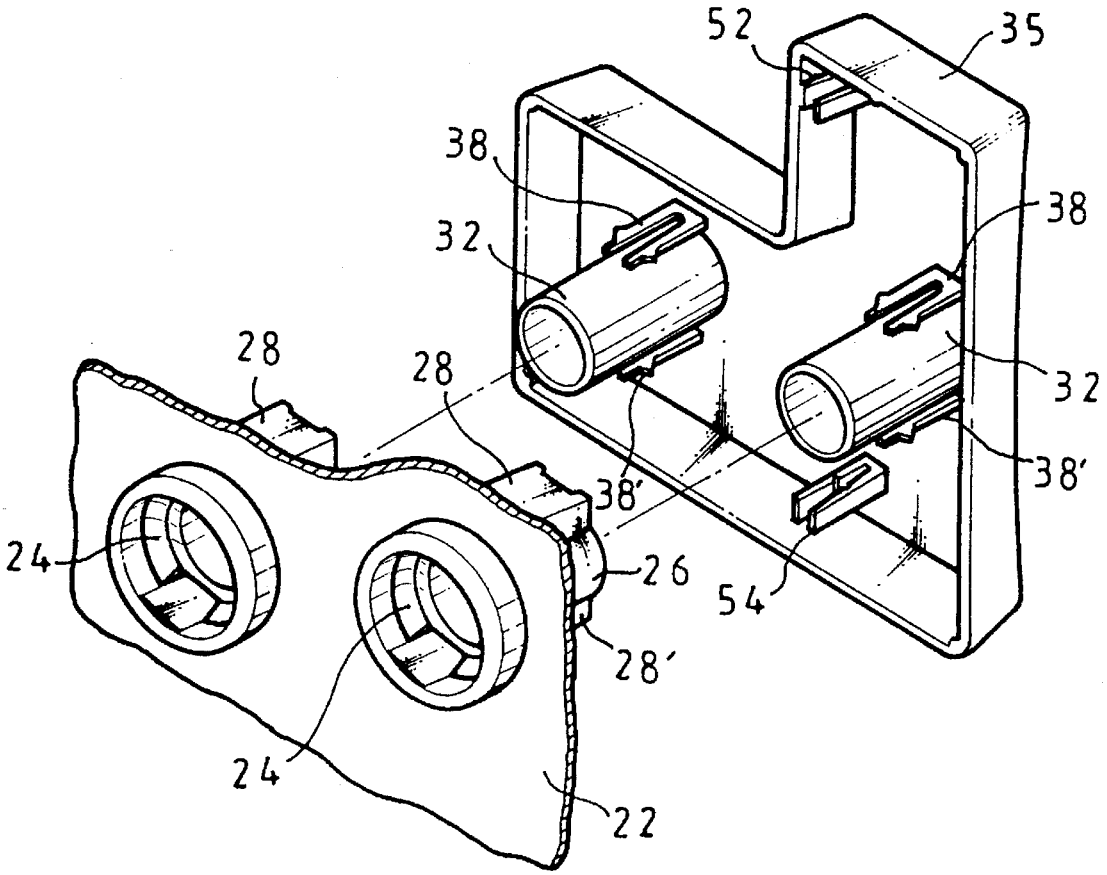
FIG. 3 is a perspective view showing a disassembled enter key switch disposed in the keyboard apparatus according to this invention.

FIG. 3 is a perspective view showing a disassembled enter key switch disposed in the keyboard apparatus according to this invention. Two key stem portions 32 are provided in one key top portion 35 of the enter key switch. The enter key switch is identical to the key switch shown in FIG. 1(*a*) in principle, except that there is no position defining pin 44 and position defining pin guide 46 in the enter key, and the shape of the key top portion 35 of the enter key is different from that of the key switch of FIG. 1(*a*). It is not necessary to form the position defining pin in the enter key switch because the assembling direction is easily decided by its shape. Meanwhile, balancing pins 52, 54 may be formed additionally to balance the enter key.

Figure 4:
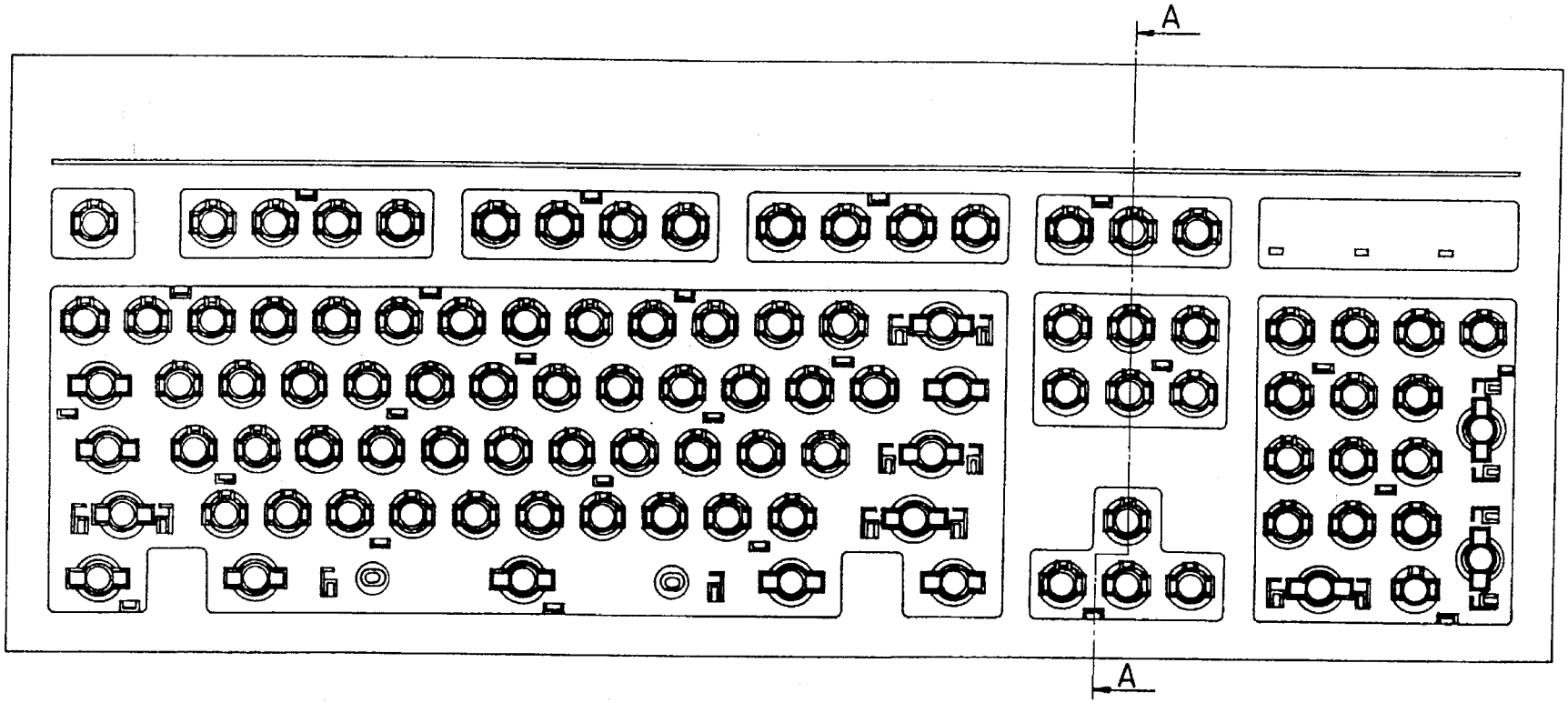
FIG. 4 is a top view showing the keyboard case in which each key holders of the key switches according to the invention are interconnected on the keyboard region in predetermined positional relationship.

FIG. 4 is a top view showing a plurality of key holders being interconnected with respect to each other on a keyboard region in a predetermined positional relationship according to this invention. The plurality of the key holders are formed with an upper case of a keyboard frame in a body by an injection molding process.

Figure 5:
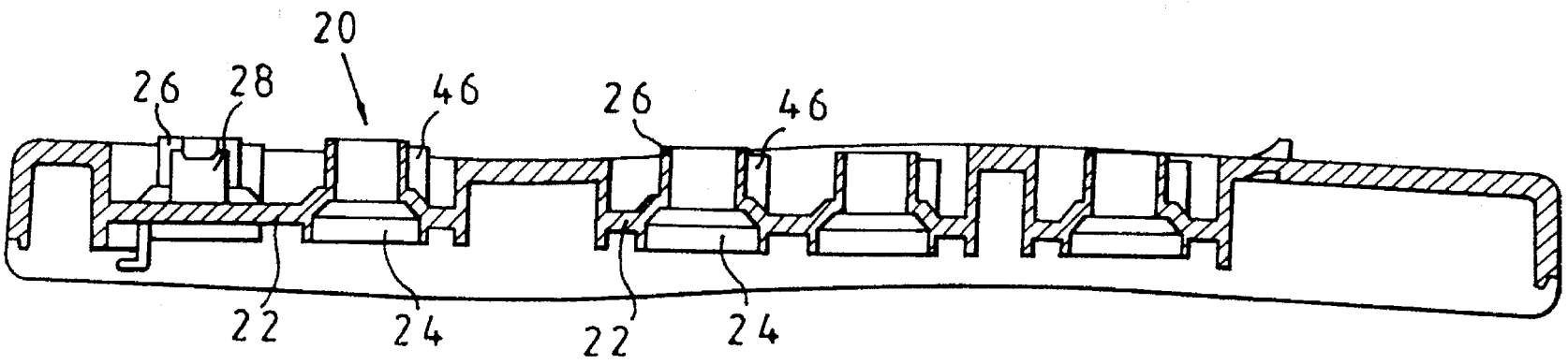
FIG. 5 is a side cross section view taken along line A—A of FIG. 4.

FIG. 5 is a cross section view taken along line A—A of FIG. 4. FIG. 5 shows that the key holder can be formed with the upper case of keyboard frame in a body.

Figure 6:
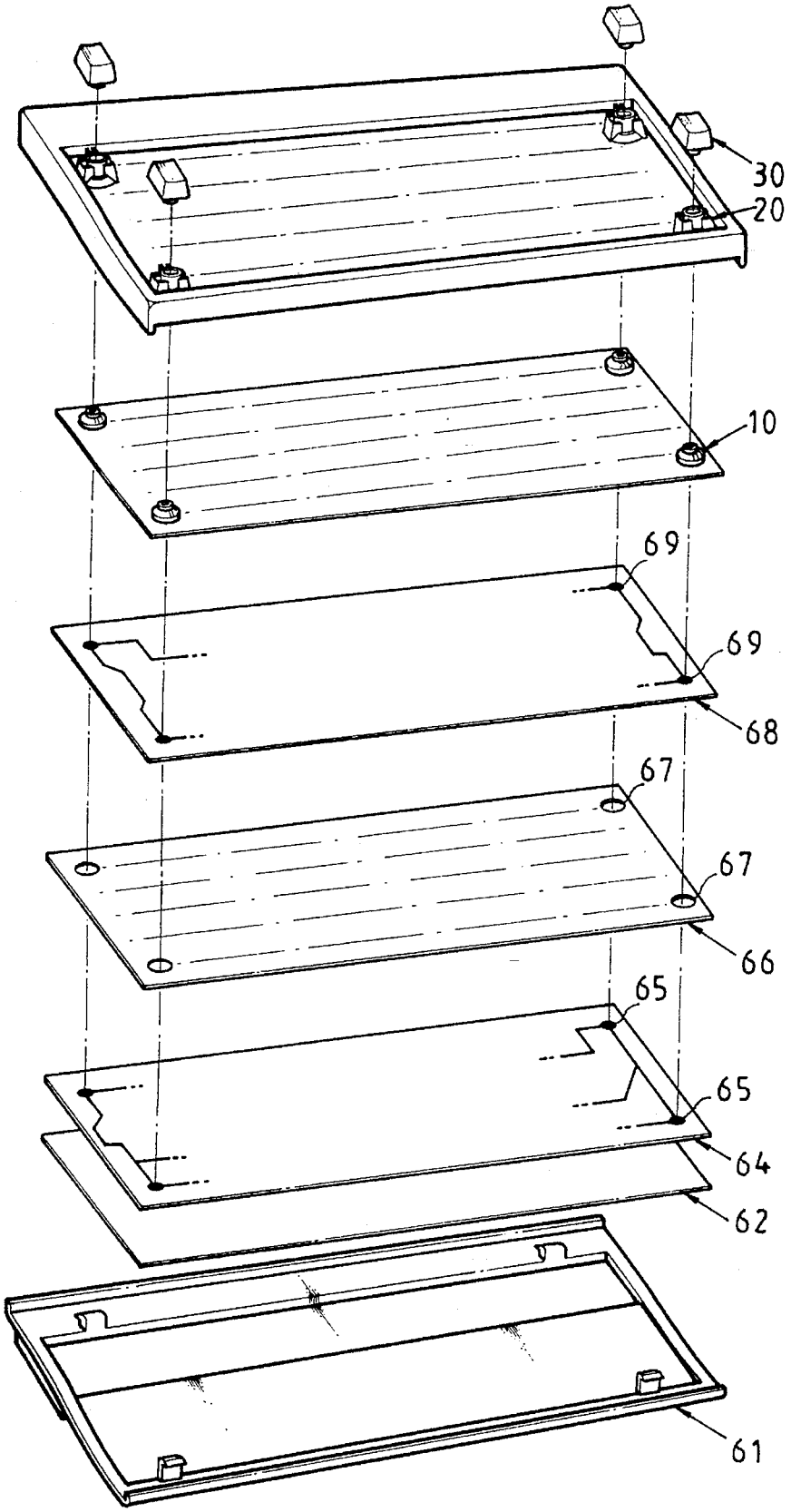
FIG. 6 is a perspective view showing a disassembled keyboard apparatus according to this invention, for explaining assembling steps.

FIG. 6 is a perspective view roughly showing a disassembled keyboard apparatus according to this invention to clearly explain the assembling steps thereof. Referring to FIG. 6, from the lower part of the drawing, a lower case 61 of the main frame, a circuit substrate 62 connected to an outer circuit (not shown), a lower sheet 64 on which the fixed contacts 65 are formed, a spacer 66 in which holes 67 are formed at the contact region between the movable contact and the fixed contact 65, an upper sheet 68 on which the movable contacts 69 are formed, a plate of interconnected rubber springs 10, an upper case of the main frame in which the key holders 20 are formed in a body, and key buttons 30 are assembled in order.

As a result of this invention, the number of component parts of the keyboard apparatus and the assembling process and the costs of production are reduced remarkably because the key top portion 34 and the key stem portion 32 are formed in a body, and a plurality of key holders are formed with the upper case of the main frame in a body. In addition, the automation of the assembling process may be accomplished easily because the key button 30 can be directly assembled with the key holder and can be separated from it.

It is to be understood that the embodiment of the invention described above has been given by way of example only and that further improvements and variants are possible within the scope of the invention.

What is claimed is:

1. A keyboard apparatus comprising;

a main frame;

a plurality of fixed contacts arranged on said main frame in a predetermined positional relationship;

a plurality of movable contacts disposed above each of said plurality of fixed contacts with a predetermined gap therebetween;

a plate of interconnected rubber springs, a respective one of said plurality of rubber springs disposed on each of said movable contacts and having a cup shaped portion of resilient rubber opened toward said movable contact;

a plurality of key buttons, a respective one of said plurality of key buttons supported elastically on each of said rubber springs for up-and-down travel movement between a rest position and a depressed position, and having a key top portion for allowing depression by a finger of an operator and a key stem portion extending from a lower surface of said key top portion, a lower end of said key stem portion pressing said movable contact in said depressed position to bring said movable contact into contact with said fixed contact;

a plurality of key holders mounted on said main frame, each of said key holders having a key stem guide portion for receiving said key stem portion to guide said up-and-down travel movement of said key button, and a cup shaped rubber spring receiving portion for receiving and contacting at least a portion of said cup shaped portion of said rubber spring; and hooking means for connecting together said key button and said key holder.

2. A keyboard apparatus in accordance with claim 1, wherein said hooking means includes a hook having a leg extending in a downward direction from a lower surface of said key top portion in parallel with said key stem portion and a projection disposed on said leg protruding transversely to the extending direction of said leg, and a stopping sill for cooperating with said hook.

3. A keyboard apparatus in accordance with claim 2, wherein said hook has at least a pair of legs which are disposed opposed to each other, and said projections of each of said respective legs are protruding in an opposite direction with respect to each other.

4. A keyboard apparatus in accordance with claim 3, wherein said legs are deformable elastically in a direction transverse to the extending direction of said legs.

5. A keyboard apparatus in accordance to claim 3, wherein said projection protrudes in a triangular shape.

6. A keyboard apparatus in accordance to claim 1, wherein said key holders associated with said key buttons are interconnected with respect to each other in a body.

7. A keyboard apparatus in accordance to claim 1, wherein said key button further includes a position defining pin extended from the key top portion, and said key holder further includes a position defining pin guide corresponding with said position defining pin to assemble the key button with the key holder in a predetermined position.

* * * * *